United States Patent [19]

Kriechbaum et al.

[11] Patent Number: 4,472,934

[45] Date of Patent: Sep. 25, 1984

[54] PNEUMATIC GRIPPER

[75] Inventors: Kurt Kriechbaum; Rainer Studtmann, both of Ingolstadt; Johann Walk, Eichstätt; Fritz Haller, Ingolstadt, all of Fed. Rep. of Germany

[73] Assignee: Schubert & Salzer Maschinenfabrik, Ingolstadt, Fed. Rep. of Germany

[21] Appl. No.: 484,171

[22] Filed: Apr. 12, 1983

[30] Foreign Application Priority Data

Apr. 16, 1982 [DE] Fed. Rep. of Germany ..... 3213128

[51] Int. Cl.[3] ..... D01H 9/08; B66C 1/46

[52] U.S. Cl. ..... 57/275; 294/87 R; 294/99 R

[58] Field of Search ..... 57/266, 274, 275; 242/35.5 A, 35.5 T, 46; 294/86.12, 86.15, 86.17, 86.26, 86.27, 86.32, 87.1, 93, 148, 149, 150, 164, 165, 902

[56] References Cited

U.S. PATENT DOCUMENTS

| | | | |
|---|---|---|---|
| 3,059,406 | 10/1962 | Ingham | 57/275 X |
| 3,633,959 | 1/1972 | McCollough et al. | 294/87.1 |
| 3,808,788 | 5/1974 | Viglione | 57/275 |
| 4,339,912 | 7/1982 | Close | 57/275 |

FOREIGN PATENT DOCUMENTS

| | | | |
|---|---|---|---|
| 1180285 | 10/1964 | Fed. Rep. of Germany | 57/275 |

*Primary Examiner*—Donald Watkins

*Attorney, Agent, or Firm*—Dority & Flint

[57] ABSTRACT

In a pneumatic gripper for bobbin changer devices with an elastically deformable collar in the gripper housing, the gripper housing (2) and the collar (3) are of bell-shaped construction. The collar (3) is inserted into the gripper housing (2). The collar (3) overlaps the edge (20) of the gripper housing (2) and is pressed airtightly against the edge (20) by means of a screw collar ring (4). The gripper can be produced with a simple construction and cheaply and retains the cop with directional stability.

10 Claims, 3 Drawing Figures

PNEUMATIC GRIPPER

BACKGROUND OF THE INVENTION

The invention relates to a pneumatic gripper for bobbin changer devices provided on spinning machines or twisting machines. The pneumatic gripper includes a gripper housing and an elastically deformable collar arranged therein and adapted to be pressed against the outer circumference of a bobbin sleeve by pressurized air.

A pneumatic gripper with an elastically deformable collar, which is pressed against the outer circumference of a bobbin sleeve when pressurized air is fed into the gripper, is known (German Pat. No. 1,180,285). This gripper, intended for doffer devices in continuously operating bobbin changers for spinning machines, has a gripping head which is attached by means of a flexible hose to a pressurized air source and is mounted with free mobility in its support in order to compensate movement fluctuations. A sleeve, which is fixed to the lower part of the gripper head, serves to receive an annular rubber collar of U-shaped cross-section. Pressurized air can be introduced into and released from the annular collar, the outer edge and inner edge of which are pressed airtightly against the gripper head, through a longitudinal bore in the gripper head. When pressurized air is introduced, the inner part of the annular collar is pressed against the free end of the bobbin sleeve projecting beyond the sleeve winding, so that this sleeve is retained in the gripping orifice of the gripper and the bobbin can be doffed from the spindle by raising the gripper. When the gripper releases the bobbin, a striker which projects into the gripping orifice and is required for the centering of the gripper head in its support, acts as an ejector.

The disadvantages of the known gripper are the technical production outlay and the movement of the annular collar relative to the wall of the sleeve surrounding it which occurs when pressurized air is fed into the gripper. The annular collar is subjected to wear as a result of this relative movement. Since the gripper engages only the free end of the bobbin sleeve projecting beyond the winding, a high pressure is also required to generate a sufficiently intense clamping of the bobbin sleeve. Furthermore, the directional stability in the holding of the bobbin sleeve is impaired by the fact that the folds which form on the inner part of the annular collar when the gripper is inflated are braced against the moving outer part of the annular collar. The known pneumatic gripper is, therefore, less suitable for the creeling of bobbin sleeves on spindles or journals which demands high directional stability.

SUMMARY OF THE INVENTION

The object of the invention is to provide a pneumatic gripper which avoids these disadvantages and in which no movement of the collar relative to the housing wall occurs, together with an economical construction favorable to technical production.

This object is achieved according to the invention in that the gripper housing and the collar are of bell-shaped construction and the collar is inserted into the gripper housing while it overlaps the open edge of the gripper housing and is pressed airtightly against the edge by means of a screw collar ring.

It is thus now possible to produce the gripper with a simple construction and cheaply, which is particularly important where it is used in statinary bobbin changer devices which have a large number of grippers. The construction of the invention also achieves that the bobbin sleeves and the bobbins or cops are held by the gripper with direction stability, because the folds in the collar which form during inflation are braced against the rigid wall of the gripper housing.

The directionally stable gripping and holding of the sleeves and bobbins is further improved, in a further development of the invention, by the fact that the effective gripping length of the gripper extends beyond the top winding layers of the bobbin sleeve. This also results in a reduction of the contact pressure necessary for secure clamping of the bobbin end in the gripper, so that the gripper can be used for all types of bobbin sleeves, even for extremely thin-walled sleeves. Adaptation of the gripper shape to the free end of the bobbin sleeve and the adjacent conical cop tip is achieved in that the gripper housing and the collar are of substantially cylindrical construction in their upper part and conical in their lower part. The axial reactive force which occurs during gripping of the bobbin is thereby reduced. The contact pressure of the collar against the outer circumference of the bobbin or bobbin sleeve can be varied locally by a variable wall thickness of the collar. The wall thickness of the substantially cylindrical section of the collar which is adapted to be pressed against the free end of the bobbin sleeve is advantageously smaller than that of the section of conical construction, whereby the component of force acting towards the spindle bearing is further reduced.

In a preferred embodiment, the gripper housing exhibits at its end face bores through which pressurized air can be introduced into the space between the gripper housing and the collar. As a result, the gripper can be fixed in a simple manner to a gripper beam extending along the spinning machine or twisting machine and connected to a pressurized air duct integrated into the gripper beam. In this case, it is provided that the outer edge of the end face of the gripper housing is a sealing surface in contact with the gripper beam.

Further advantages of the invention will appear from the following description of an exemplary embodiment which is given with reference to the accompanying drawings, wherein:

DESCRIPTION OF A PREFERRED EMBODIMENT

Figure 1:
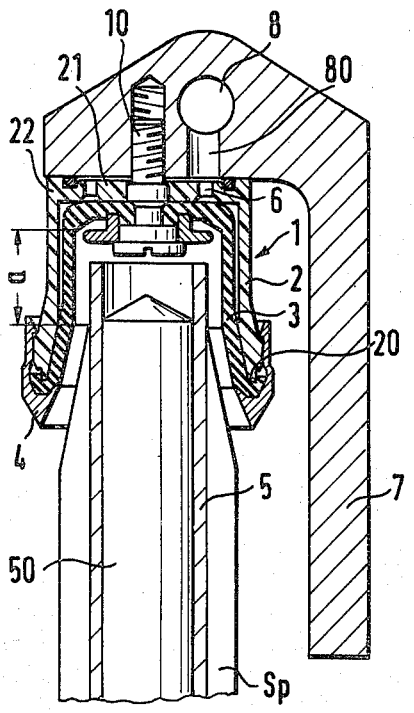
FIG. 1 is a longitudinal sectional view of a pneumatic gripper constructed according to the invention in the pressureless state.

In FIG. 1, the reference character 1 designates a pneumatic gripper lowered onto a bobbin (cop) Sp, which consists of a gripper housing 2 of bell-shaped construction, a collar 3, likewise of bell-shaped construction, inserted into the gripper housing 2, and a screw collar ring 4. The bell-shaped collar 3 inserted into the gripper housing 2 overlaps the open edge 20 of the gripper housing 2 and is pressed airtightly against the edge 20 by means of the screw collar ring 4 pressed onto the gripper housing 2 and engaged thereon. The collar 3 consists of an elastically deformable material, whereas the gripper housing 2 is advantageously produced from a stable plastic material.

The gripping length of the gripper 1, dictated by the collar 3, is preferably dimensioned so that it extends beyond the top winding layers of the bobbin Sp. In order to adapt it to the approximately cylindrical free end of a bobbin sleeve 5 forming the core of the bobbin Sp and of the adjacent conical winding of the sleeve with yarn, the collar is of substantially cylindrical construction in its upper part a facing the free end of the bobbin sleeve 5 and conical in its lower part facing the top winding layers. The gripper housing 2 is adapted to this construction of the collar 3.

Figure 2:
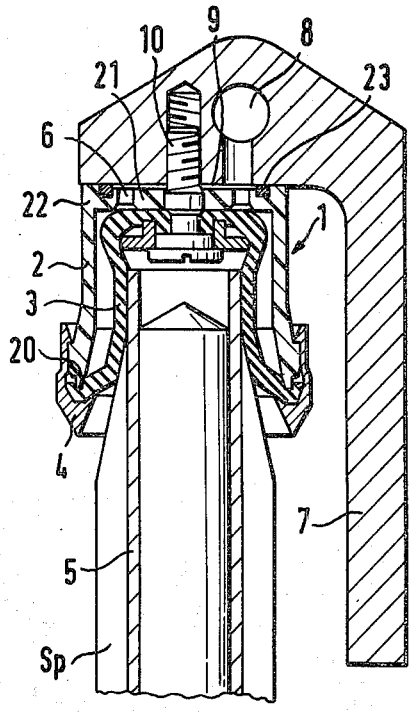
FIG. 2 shows the gripper according to FIG. 1 supplied with pressurized air.

In order to vary the gripping intensity of the gripper 1 or of the collar 3 locally, the wall of the collar 3 is made of varying thickness, preferably in the manner illustrated in FIGS. 1 and 2, so that the substantially cylindrical section a of the collar has a smaller wall thickness than the adjacent conical part. The bell end of the collar 3 advantageously also has a wall thickness corresponding or similar to the conical part.

The supply of pressurized air into the space between the gripper housing 2 and the collar 3 occurs through at least one bore 6 in the end face 21 of the gripper housing. Optionally, the bore may also be relocated into a side wall of the gripper housing 2. In a preferred embodiment, the end face 21 of the gripper housing has four bores 6 while two at a time of the bores 6 arranged on a circular path are mutually opposite. The gripper 1 is fixed rigidly by means of a screw 10 to a gripper beam 7, of a stationary bobbin changer device, extending along the spindle row of a spinning machine or twisting machine, for which changer device it is particularly intended. Obviously, however, it may also be used in the case of a bobbin changer traveling along the spindle row. The screw 10 serving as releasable fixing means is advantageously arranged asymmetrically in the gripper beam 7 and symmetrically in the gripper 1.

A pressurized air duct 8 connected to a pressurized air source is integrated into the gripper beam 7, which carries a number of grippers 1 corresponding to the number of the spindles and is movable up and down in known manner. The gripper beam 7 therefore serves simultaneously as a pressurized air duct. A bore 80 leading away radially from the pressurized air duct 8 connects the pressurized air duct 8 to the bores 6 in the end face 21 of the gripper housing. In order to permit the supply of pressurized air to all four bores 6, the outer edge 22 of the end face 21 is raised so that it alone is in contact with the wall of the gripper beam 7 and a circular cavity 9 is present between the surface of the end face 21 containing the bores 6 and the gripper beam 7, into which cavity the bore 80 opens. The edge 22 enclosing the cavity 9 then serves simultaneously as a sealing surface, which seals the cavity 9 from the atmosphere. An O-ring 23 may further be inserted into the end face 21 as an additinal sealing means. The radius of the cavity 9 is greater than the distance between the centre of the screw 10 and the outer wall of the bore 80.

In order to engage a bobbin Sp mounted on a spindle 50, the gripper 1 is lowered onto the bobbin according to FIG. 1, while the top end of the bobbin enters the orifice formed by the screw collar ring 4 and the bell-shaped collar 3. The introduction of the bobbin end into the gripping orifice is facilitated by a conical construction of the orifice of the screw collar ring 4. Pressurized air is then supplied to the pressurized air duct 8, flowing through the bore 80 and the bores 6 into the space between the gripper housing 2 and the collar 3. The collar 3 is thereby inflated and pressed against the outer circumference of the bobbin end, while the substantially cylindrical part a of the collar 3 is applied to the free end of the sleeve 5, and the conical part to the topmost winding layers. The contact pressure of the cylindrical part a is then greater, due to its smaller wall thickness, than that of the conical part of the collar 3 so that damage to the yarn layers is prevented and the component of force acting towards the spindle bearing during contacting is reduced. This construction of the collar 3 also results in an air requirement which is only small for a sufficiently high contact pressure.

Figure 3:
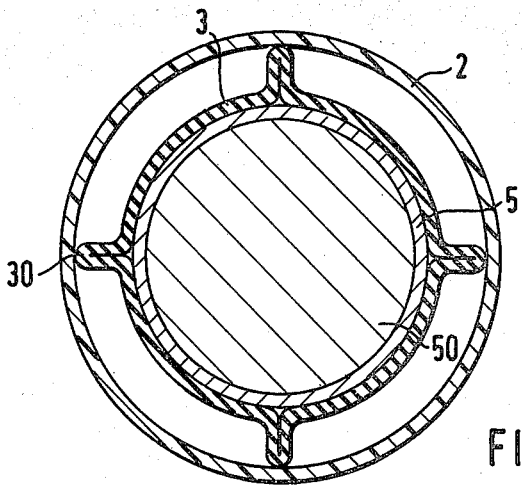
FIG. 3 is an enlarged cross-sectional view of the gripper according to FIG. 2.

As a result of the supply of pressurized air into the gripper 1, the inside diameter of the bell-shaped collar 3 is reduced and folds 30 are formed (FIG. 3) which divide the space between the gripper housing 2 and the collar 3 into cells. The folds 30 are braced against the inner wall of the gripper housing 2. Since the gripper housing 2 is rigid, the bobbin Sp is maintained clamped with directional stability by the collar 3 so that after it has been doffed from the spindle 50, by the raising of the gripper, it can be deposited with great precision upon a support; for example, a pin or cup of a conveyor belt. An empty bobbin sleeve can be creeled onto a spindle 50 of the spinning machine or twisting machine by a gripper 1 with equal precision. After the bobbin Sp has been placed on the support, the gripper 1 is vented. The pressurized air then flows through the four bores 6 and the bore 80 into the pressurized air duct 8 which occurs as rapidly and reliably as the introduction of the pressurized air into the gripper 1.

While a preferred embodiment of the invention has been described using specific terms, such description is for illustrative purpose only, and it is to be understood that changes and variations may be made without departing from the spirit or scope of the following claims.

What is claimed is:

1. A pneumatic gripper for bobbin changer devices in spinning machines or twisting machines, which comprises a gripper housing and an elastically deformable collar arranged in the gripper housing and adapted to be pressed against the outer circumference of a bobbin sleeve, wherein said gripper housing (2) and said collar (3) are of bell-shaped construction and said collar (3) is inserted into said gripper housing (2), a portion of said collar overlapping an open edge of said gripper housing (2) and a screw collar ring pressing said overlapping portion airtightly against said edge (2).

2. A pneumatic gripper as claimed in claim 1, wherein the effective gripping length of the gripper (1) extends beyond the top winding layers of the bobbin sleeve (5).

3. A pneumatic gripper as claimed in claim 1 wherein said gripper housing (2) and said collar (3) are of substantially cylindrical construction in their upper part and conical in their lower part.

4. A pneumatic gripper as claimed in claim 1 wherein said collar (3) has a varying wall thickness.

5. A pneumatic gripper as claimed in claim 4, wherein the wall thickness of the substantially cylindrical section (2) of the collar (3) which is adapted to be pressed against the free end of the bobbin sleeve (5) is smaller than that of the section of conical construction.

6. A pneumatic gripper as claimed in claim 1 wherein the gripper housing (2) exhibits at its end face (21) bores (6) through which pressurized air can be introduced into the space between the gripper housing (2) and the collar (3).

7. A pneumatic gripper as claimed in claim 1 further comprising:

a gripper beam (7) extending along the spinning machine or twisting machine, a pressurized air duct (8) integrated into the gripper beam (7), and said gripper being fixed rigidly to said gripper beam and being in communication with said pressurized air duct.

8. A pneumatic gripper as claimed in claim 7, further comprising:

an outer edge (22) of an end face (21) of said gripper housing (2) is a sealing surface in contact with said gripper beam (7).

9. A pneumatic gripper as claimed in claim 8, wherein said sealing surface encloses a cavity (9) into which a bore (80) leading away from the pressurized air duct (8) opens.

10. A pneumatic gripper as claimed in claim 7 wherein a fixing means (10) for said gripper (1) is arranged asymmetrically in the gripper beam (7) and symmetrically in the gripper (1).

* * * * *